United States Patent [19]

Rizzon et al.

[11] Patent Number: 4,554,053

[45] Date of Patent: Nov. 19, 1985

[54] METHOD AND DEVICE FOR REMOVAL OF HEAVY TAR FROM A COKE-OVEN GAS DURING COOLING

[75] Inventors: John Rizzon; Günter Adomat; Peter Diemer, all of Essen, Fed. Rep. of Germany

[73] Assignee: Krupp-Koppers GmbH, Essen, Fed. Rep. of Germany

[21] Appl. No.: 553,476

[22] Filed: Nov. 18, 1983

[30] Foreign Application Priority Data

Dec. 22, 1983 [DE] Fed. Rep. of Germany ..... 3247390

[51] Int. Cl.[4] ..... C10B 55/00

[52] U.S. Cl. ..... 201/21; 201/28; 201/45

[58] Field of Search ..... 201/4, 8, 21, 28, 45

[56] References Cited

U.S. PATENT DOCUMENTS

| | | | |
|---|---|---|---|
| 175,744 | 4/1876 | Penrose et al. | 201/8 |
| 1,182,738 | 5/1916 | Becker | 201/8 |
| 1,888,465 | 11/1932 | Miller | 201/4 |
| 2,610,944 | 9/1952 | Hemminger | 201/4 |
| 3,962,043 | 6/1976 | Schmalfeld et al. | 201/21 |
| 4,053,569 | 10/1977 | Hahn | 201/21 |
| 4,055,471 | 10/1977 | Beck et al. | 201/21 |
| 4,086,144 | 4/1978 | Grulich et al. | 201/45 |
| 4,123,331 | 10/1978 | Laufhutte | 201/4 |
| 4,142,941 | 3/1979 | Weber et al. | 201/8 |

*Primary Examiner*—Peter Kratz

*Attorney, Agent, or Firm*—Michael J. Striker

[57] ABSTRACT

In a method of removing heavy tar produced in a coke oven during the cooling of a coke-oven gas from the coke-oven gas, the heavy tar pieces are crushed in a pulverizer to obtain particles of the size of less than 1 mm. The heavy tar particles are then rarefied by the addition to them of a mixture of tar and water. The resulting mixture is maintained under the temperature of 55°-75° C. and then transported to a charge coal which is then charged into the coke-oven.

5 Claims, 1 Drawing Figure

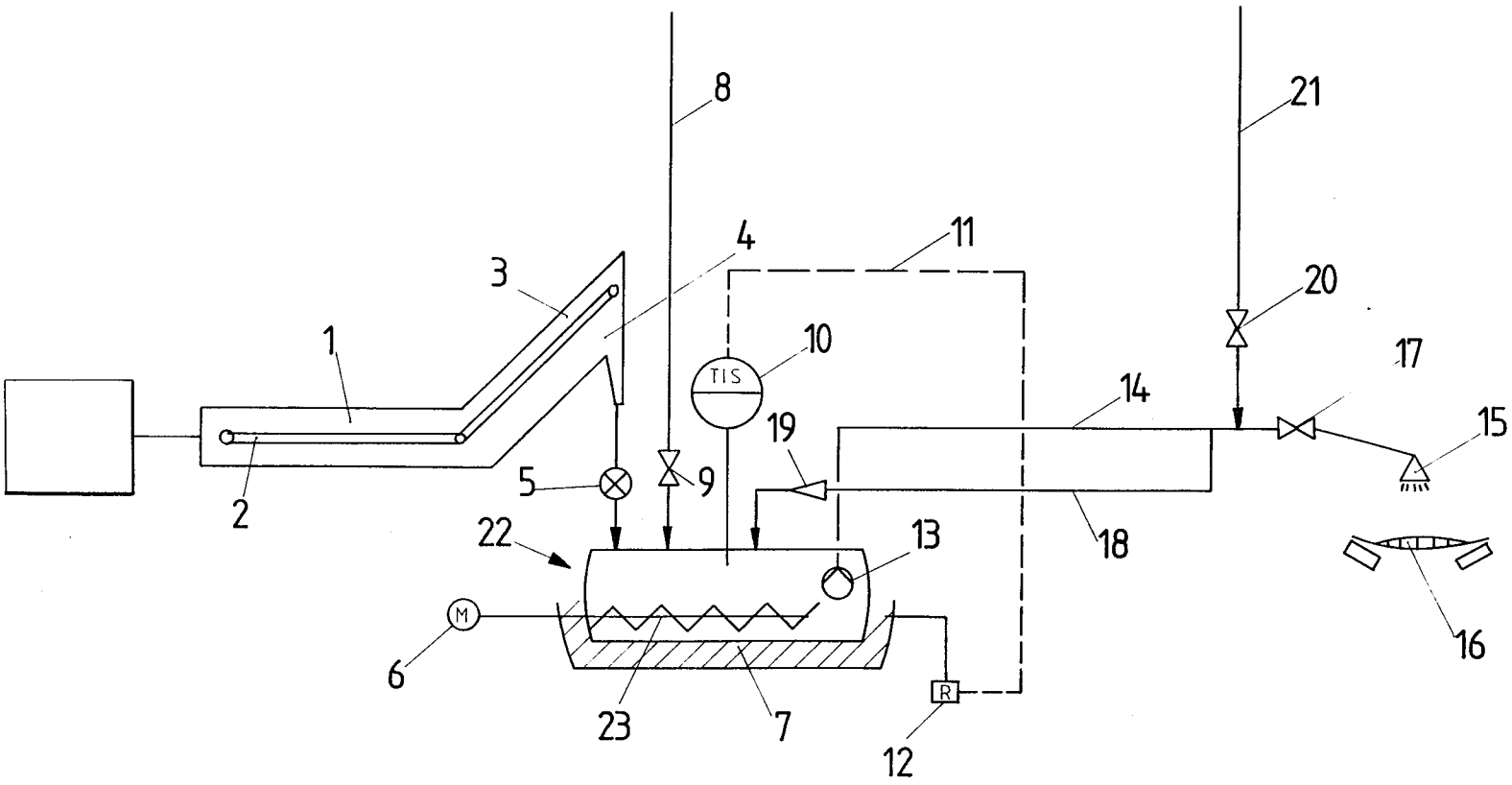
1
2
3
4
5
6
7
8
9
10
TIS
11
12
R
13
14
15
16
17
18
19
20
21
22
23
M

METHOD AND DEVICE FOR REMOVAL OF HEAVY TAR FROM A COKE-OVEN GAS DURING COOLING

BACKGROUND OF THE INVENTION

The present invention relates to a method of removing heavy tar produced in a coke oven during its cooling from a coke-oven gas. The invention also relates to an apparatus for carrying out the above method.

It has been known that during the cooling of the coke-oven gas a tar-containing condensate is separated from a raw gas. This condensate is first fed into a suitable collecting container (tar separator) in which the condensate is separated into a water phase, a tar phase and a heavy tar phase. The tar phase is normally further dewatered in a pressure separator whereby a portion of a so-called heavy tar can be further separated from the tar. A particularly viscous and slurry-like tar fraction is identified as a heavy tar which includes a specifically high content of solid materials, particularly coal and coal dust.

The exemplified composition of the typical heavy tar removed from the coke-oven gas is as follows:

Tar: about 40–70 weight %

Solid substances (coal, coke, graphite): about 30–50 weight %

Water: about 10 weight %

The quantity of the heavy tar produced in the coke-oven, the batteries of which have been charged with wet coal, amounts to about 3–9 kg of the heavy tar per 1000 $M^3n$ of the coke-oven gas. If the coke oven batteries are loaded with a preheated coal the quantity of the accumulated heavy tar can be increased up to 50–100% as compared to the above disclosed quantity. Because of the high content of the solid materials in the heavy tar a processing of the heavy tar in a consecutive tar destillation is not possible. Since no other possibilities of the processing of the heavy tar have been suggested in the industry, the heavy tar must have been removed from the coke-oven.

SUMMARY OF THE INVENTION

It is an object of the present invention to provide an improved method of removing a heavy tar produced during the cooling of a coke-oven gas in a coke-oven.

It is a further object of the invention to provide a method and apparatus for removing the heavy tar from the coke-oven gas, which is inexpensive, automatic and not detrimental to the environment.

These and other objects of the invention are attained by a method of removing heavy tar produced in a coke-oven during the cooling of a coke-oven gas from the coke-oven gas, comprising the steps of crushing coarse pieces of the heavy tar so as to obtain particles of the size of $\leqq 1$ mm; rarefying said particles in a mixer by adding to said particles a mixture of tar and water to obtain a heavy tar-water mixture; heating the obtained mixture and maintaining the temperature of this mixture between 55 and 75 degrees C.; and conveying the heavy tar-water mixture to a raw charge coal disposed on a raw coal conveyor belt.

According to the inventive method the heavy tar produced in the coke oven is first crushed in a pulverizer so as to reduce the size of the particles to $\leqq 1$ mm and then the heavy tar is rarefied by the addition thereto of a tar-water mixture.

The rarefying process is carried out such that the mixture obtained in said rarefying step contains 15 to 30 weight percent of the heavy tar and 70 to 85 weight percent of tar-water mixture.

The water content in the mixture utilized in the rarefying step contains 15 to 30 weight percent of the heavy tar and 70 and 85 weight percent of tar-water mixture.

The water content in the mixture utilized as a rarefying medium can be varied. Preferably, this mixture contains between 40 and 60 weight percent of water. It is also possible to use a mixture in which the water content is below 5 weight percent. The mixture resulting from the rarefying step normally already has an increased temperature. It should be, however, provided that the temperature of the resulting mixture be maintained between 55° and 75° C. The temperature therefore is adjusted so that the viscosity of the mixture is brought to such a value that a uniform distribution of the heavy tar in the mixture is possible. The water mixture is then pumped into a distribution device, through which the mixture is uniformly applied onto a coal charge disposed on the raw coal conveyor belt. The heavy tar is then together with the raw coal charge conveyed back to the oven chambers of the coke oven battery.

Coking processes has been known, in which limited quantities of normal tar or a predetermined tar-oil-fraction have been added to the raw coal charge. The purpose of such an addition was to improve coking properties of the raw charge coal; the added tar or tar-oil-fraction and the charge coal have been subjected to solidification by stamping or briquetting. In these known processes, however, no suggestions have been made to utilize a method similar to the method of the invention because, on the one hand, no heavy tar was available for feeding into the coke oven and, on the other hand, no subsequent solidifying of the raw coal sprayed with the heavy tar was provided. This means that the heavy tar should not serve as a bonding medium and should not affect any other improvements in the coking qualities of the charge coal. Therefore the addition of the heavy tar to the charge coal not only does not limit the quantity of the charge coal but also adjusts it after the heavy tar is charged into the gas processing device, e.g. oven, whereby the whole heavy tar produced in the coke oven can be added to the charge coal.

The objects of the invention are also attained by an apparatus for removing heavy tar produced in a coke oven during the cooling of a coke-oven gas from the coke-oven gas, comprising means for crushing coarse pieces of the heavy tar so as to obtain particles of the size of $\leqq 1$ mm; a mixer receiving said particles; means for adding to said particles a mixture of heavy tar and to obtain a heavy tar-water mixture, means for heating the obtained mixture so that the temperature of this mixture is maintained between 55° and 75° C.; and means for conveying the heavy tar-water mixture to a raw charge coal.

The heating means may include a heating casing on said mixer.

The apparatus according to the invention may further include a conveying screw located in said mixer.

The apparatus may further include a plunger pump disposed in said mixer and pumping the heavy tar-mixture into said conveying means.

Means for controlling the temperature of said heavy tar-water mixture in said mixer may be provided.

The novel features which are considered as characteristic for the invention are set forth in particular in the appended claims. The invention itself, however, both as to its construction and its method of operation, together with additional objects and advantages; thereof, will be best understood from the following description of specific embodiments when read in connection with the accompanying drawing.

BRIEF DESCRIPTION OF THE DRAWING

The sole FIGURE of the drawing diagrammatically illustrates a method and apparatus for removal of heavy tar from a coke-oven gas accumulated in the oven during the cooling of the coke-oven gas.

DETAILED DESCRIPTION OF THE PREFERRED EMBODIMENTS

Referring now to the drawing in detail, a reference numeral 1 designates a separator which can be of any suitable known construction normally employed in a coking industry. A tar-containing condensate transported to the separator 1 from a coke-oven 30 is separated in separator 1 into three phases, namely water, tar and heavy tar obtained in a predetermined sequence. The heavy tar phase accumulated on the bottom of the container of separator 1 is grasped by a scraper chain conveyor 2 arranged above the bottom of the separator and transported upwardly in the arm-like portion of the separator towards the tip. The heavy tar then falls out through a discharge opening 4 of the separator 1 into a crusher or pulverizer 5, also of any suitable conventional structure. Coarse pieces of the heavy tar are crushed in pulverizer 5 into particles of the size $\leqq 1$ mm. The heavy tar particles are then fed into the container of a mixer 22 provided with a heating envelope or casing 7. To obtain rarefaction of the heavy tar a required mixture of tar-water is fed into mixer 22 via a conduit 8 having a valve 9.

In order to avoid deposits of the tar on the walls of the mixer a conveyor screw 23 is arranged at the lower part of the mixer. Conveyor screw 23 is driven by a motor 6 positioned outside of the mixer 22. The heating casing 7 serves to maintain the temperature of the mixture in mixer 22 between 55° and 75° C., preferably 60°. The temperature measuring device 10 is of any known suitable construction. The value of the temperature measured by device 10 is transmitted via a conductor 11 to a controller 12 which controls heating of the casing 7. The temperature is regulated within a given range so that the mixture in mixer 22 has a sufficiently low viscosity and a uniform distribution of the tar particles in the mixture is obtained. The warm mixture having the preferable temperture of 60° is conveyed by means of the conveying screw 23 to a suction inlet of a rotary plunger pump 13. A so-called gear-type pump can be employed as a pump, which presses the heated mixture into a conduit 14 leading to a heavy tar nozzle 15. The mixture passing through the nozzle 15 is uniformly sprayed onto a coal charge disposed on a raw coal conveyor belt 16.

At a short distance from the heavy tar nozzle 15 is arranged in the conduit 14 a valve 17, which automatically closes when the raw coal conveyor belt 16 is inoperative. Thus a further application of the heavy tar-containing mixture onto the coal charge when the conveyor belt is at stand-still, is avoided.

When valve 17 is closed, the mixture is fed back to the mixer 22 via a reverse conduit 18. A conical constriction 19 is provided in the conduit 18 as a throttle means for a pressure built-up. Since this constriction is subject to erosion, as has been estimated, the constriction 19 may be formed of an erosion-resistant material and so constructed that it can be easily replaced by a new one. A valve 20 in a circulation water conduit 21 may be opened, whereby the tar-feeding conduits 14 and 18 can be supplied with water. Thereby it is warranted that no tar sediments can be deposited on the walls of the conduits.

The above described method requires considerably low expenses and provides a continuous and fully automatic removal of the heavy tar accumulated in the coke oven whereas the known devices have not been modified for heavy tar separation. It is, of course, understood that in place of one heavy tar nozzle 15 a plurality of individual nozzles may be employed when a uniform distribution of the heavy tar-containing mixture throughout the raw coal conveyor belt is required.

It should be noted that the diagrammatic view of the drawing shows only the structural components which are necessary for carrying out the proposed method. The remaining structural components, which are known in the art, namely the structure of the coke oven, in which coke gases with a heavy tar are produced, as well as means for connecting the charge coal conveyor 16 to the coke oven are not illustrated in the drawing for the sake of simplicity.

It will be understood that each of the elements described above, or two or more together, may also find a useful application in other types of methods of separating heavy tar from coke-oven gases differing from the types described above.

While the invention has been illustrated and described as embodied in a method and device for removal of heavy tar from a coke oven-gas, it is not intended to be limited to the details shown, since various modifications and structural changes may be made without departing in any way from the spirit of the present invention.

Without analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of removing heavy tar produced in a coke oven during the cooling of a coke oven gas from the coke-oven gas, comprising the steps of crushing coarse pieces of the heavy tar so as to obtain particles having a size of $\leqq 1$ mm; rarefying said particles in a mixer by adding to said particles a mixture of tar and water to obtain a heavy tar-tar-water mixture; providing heating means in said mixer and heating the obtained mixture in said mixer and maintaining the temperature of said mixture in said mixer between 55° and 75° C. during the rarefying step to obtain a uniform distribution of the tar particles in said mixture; and then conveying the thus heated heavy tar-tar-water mixture to a raw charge coal disposed on a raw coal conveyor belt.

2. The method as defined in claim 1, wherein the mixture obtained in said rarefying step contains 15 to 30 weight percent of the heavy tar and 70 to 85 weight percent of tar-tar-water mixture.

3. The method as defined in claim 2, wherein the mixture of tar and water added to said particles in said rarefying step contains between 40 and 60 weight percent of water.

4. The method as defined in claim 3, further comprising a step of interrupting the conveying of the heavy tar-and-water mixture to the charge coal when the raw coal conveyor belt is inoperative.

5. The method as defined in claim 3, wherein the heavy tar-and-water mixture is conveyed back to the mixer when the raw coal conveyor belt is inoperative.

* * * * *